US009975126B2

(12) United States Patent
Wight

(10) Patent No.: US 9,975,126 B2
(45) Date of Patent: May 22, 2018

(54) DUAL TAPERED ORIFICE PLATE FOR A GRINDING MACHINE

(71) Applicant: WEILER AND COMPANY, INC., Whitewater, WI (US)

(72) Inventor: E. William Wight, Roscoe, IL (US)

(73) Assignee: WEILER AND COMPANY, INC., Whitewater, WI (US)

( * ) Notice: Subject to any disclaimer, the term of this patent is extended or adjusted under 35 U.S.C. 154(b) by 210 days.

(21) Appl. No.: 14/853,318

(22) Filed: Sep. 14, 2015

(65) Prior Publication Data

US 2016/0001298 A1 Jan. 7, 2016

Related U.S. Application Data

(63) Continuation of application No. 13/793,868, filed on Mar. 11, 2013, now Pat. No. 9,162,230.

(51) Int. Cl.
*B02C 18/00* (2006.01)
*B02C 18/36* (2006.01)

(52) U.S. Cl.
CPC ..... *B02C 18/365* (2013.01); *B02C 18/36* (2013.01)

(58) Field of Classification Search
CPC ..... B02C 18/365; B02C 18/30; B02C 18/36
USPC ..... 241/82.1–82.7
See application file for complete search history.

(56) References Cited

U.S. PATENT DOCUMENTS 3,664,396 A 5/1972 Tremblay
3,730,444 A 5/1973 Pattillo
3,741,772 A 6/1973 McFarland
3,934,827 A 1/1976 Seydelmann
4,023,736 A 5/1977 Pattillo et al.
4,121,918 A 10/1978 Shono et al.
4,372,008 A 2/1983 Sandberg
4,528,070 A 7/1985 Gamblin
4,821,376 A 4/1989 Sandberg
4,844,372 A 7/1989 Weiler et al.
4,900,572 A 2/1990 Repholz et al.
4,978,077 A 12/1990 Huebner et al.
5,251,829 A 10/1993 Lesar
5,289,979 A 3/1994 Lesar
5,344,086 A 9/1994 Lesar
5,405,095 A 4/1995 Lesar
5,443,214 A 8/1995 Lesar
5,640,184 A 6/1997 Moynihan et al.
5,752,316 A 5/1998 Takagi et al.
5,944,267 A 8/1999 Haack et al.
6,007,007 A 12/1999 Haack et al.
6,130,688 A 10/2000 Agarwal et al.
6,132,028 A 10/2000 Su et al.
7,051,765 B1 5/2006 Kelley et al.
(Continued)

FOREIGN PATENT DOCUMENTS

RU 57 639 U1 10/2006

*Primary Examiner* — Faye Francis
(74) *Attorney, Agent, or Firm* — Klintworth & Rozenblat IP LLP

(57) ABSTRACT

Orifice plates, grinding machines, and method of using the same are provided that can process a material. In one aspect, an orifice plate includes multiple orifices, at least one of which has two tapered segments aligned with and operably connected to each other and that taper downwardly from respective outer portions to inner portions. An intermediate bore may connect to minimum diameter portions of each of the tapering segments so that the tapering segments are connected to each other by way of the intermediate bore.

27 Claims, 5 Drawing Sheets

(56) References Cited

U.S. PATENT DOCUMENTS

| | | | |
|---|---|---|---|
| 7,461,800 | B2 | 12/2008 | Lesar et al. |
| 7,905,436 | B2 | 3/2011 | Lesar et al. |
| 2001/0052558 | A1 | 12/2001 | Younker |
| 2006/0209123 | A1 | 9/2006 | Sexton et al. |
| 2006/0274602 | A1 | 12/2006 | Roth |
| 2007/0001040 | A1 | 1/2007 | Walters |
| 2007/0090212 | A1 | 4/2007 | Lesar et al. |
| 2007/0090213 | A1 | 4/2007 | Lesar et al. |
| 2007/0090214 | A1 | 4/2007 | Lesar et al. |
| 2007/0090215 | A1 | 4/2007 | Lesar et al. |
| 2007/0090216 | A1 | 4/2007 | Lesar et al. |
| 2007/0090217 | A1 | 4/2007 | Lesar et al. |
| 2007/0090218 | A1 | 4/2007 | Lesar et al. |
| 2007/0254577 | A1 | 11/2007 | Lesar |

DUAL TAPERED ORIFICE PLATE FOR A GRINDING MACHINE

RELATED APPLICATIONS

The present application is a continuation of co-pending U.S. patent application Ser. No. 13/793,868, filed Mar. 11, 2013, which is incorporated by reference herein in its entirety.

FIELD OF THE INVENTION

The present disclosure relates to grinding machines and, more particularly, to orifice plates used in grinding assemblies of grinding machines for grinding meat and other materials.

BACKGROUND

Grinding machines are known in the food processing industries. It is widely known that some grinding machines can convert cuts of meat, trimmings, and/or other meat stock into ground meat products. This can be done by way of rotating knives that scrape across a front surface of an orifice plate while the cuts of meat and/or trimmings are pushed through orifices that extend longitudinally through the thickness of the orifice plate, such as by operation of an auger. Some orifice plates include conically tapered orifices in which entry openings of the orifices at the front surface of the orifice plate are larger than exit openings of the orifices at an opposing back surface of the orifice plate.

SUMMARY

In accordance with one aspect, a grinding machine is provided for processing materials, such as a food product, and includes a grinder assembly and an orifice plate that is operably mounted to the grinder assembly. The orifice plate has orifices, each of which has two tapering segments, which may be defined by a restriction segment and an expansion segment, that taper from locations that are near first and second end surfaces of the orifice plate downwardly and inwardly toward an intermediate portion of the orifice plate. This dual tapering of the orifices may provide an orifice plate that is symmetrical about a transversely cross-sectional plane so that the orifice has the same dimensional characteristics in a traverse direction through the orifice plate from either the first or second end surface and out of the other one of the first and second end surface. This may allow the orifice plate to be mounted with either the first or second end surface facing an upstream direction with respect to a travel path of material through the grinder assembly so that the orifice plate can be flipped over if the upstream facing one of the first and second end surfaces becomes worn due to the flow of material and/or engagement of blades of a knife assembly that may scrape against such surface, which may double the use-life of the orifice plate and reduce inventory requirements for replacement orifice plates. This may also provide orifices that have defined restriction and expansion segments, regardless of which one of the first and second end surfaces faces the upstream direction with respect to the travel path of the material through the grinder assembly. The restriction and expansion segments of each orifice may provide radial compression followed by controlled and restricted radial expansion of the material which may provide improved textural characteristics of a meat material when compared to forcing the material through either openings having constant diameters or openings having continuously reducing diameters along their entire lengths. The radial compression in the restriction segment followed by controlled and restricted radial expansion of the material in the expansion segment of the orifice plate may also prevent shattering of frozen material that is being ground with the grinding machine.

In accordance with another aspect, a method of using a grinding machine for processing a material, such as a food product, is provided. The method includes mounting an orifice plate that has multiple orifices extending there through in a grinder assembly in a first position in which a first end surface of the orifice plate faces an upstream direction with respect to a travel path along which the material is conveyed through the grinder assembly. A second end surface of the orifice plate faces downstream with respect to the travel path of the material. Material is forced through multiple orifices of the orifice plate while the orifice plate is in the first position. The orifice plate is then mounted in a second position in the grinder assembly in which the second end surface of the orifice plate faces the upstream direction with respect to the travel path of the material and the first end surface of the orifice plate faces the downstream direction with respect to the travel path of the material. Material is forced through the multiple orifices of the orifice plate while the orifice plate is in the second position.

In accordance with a further aspect, a grinding machine for processing a material, such as a food product, is provided and includes a grinder assembly that can receive a material to be processed and can convey the material along a travel path that extends generally longitudinally with respect to the grinder assembly. An orifice plate is arranged with respect to the grinder assembly so that the material is forced through the orifice plate while being conveyed through the grinder assembly. The orifice plate includes a first end surface that faces upstream with respect to the travel path of the material and a second end surface that faces downstream with respect to the travel path of the material. Multiple orifices extend through the orifice plate, generally transversely between the first and second end surfaces. Each of the multiple orifices includes a first opening defined at the first end surface and having a first width and a second opening defined at the second end surface and having a second width. An intermediate bore is arranged between the first and second openings and define a third width that is smaller than each of the first and second widths. A restriction segment may be defined between the first opening and the intermediate bore and an expansion segment may be defined between the intermediate bore and the second opening.

According to still another aspect, (i) the first opening and restriction segment, and (ii) the second opening and the expansion segment are mirror images of each other about a cross-sectional plane extending transversely through a center of the orifice plate.

According to still a further aspect, the first and second openings may have circular perimeter shapes and a common diameter. The intermediate bore may have a circular perimeter shape and may be aligned coaxially with respect to the first and second openings.

According to yet another aspect, each orifice may include a first outer bore that extends from the first opening in the first end surface, toward the central bore, and a second outer bore that extends from the second opening in the second end surface, toward the central bore. The first and second outer bores may have the same diameter as the first and second openings. The first and second outer bores may each define a length thereof and each of the diameters of the first and second outer bores are constant along the respective lengths.

According to yet a further aspect, the restriction segment includes a tapering bore that extends between the first outer bore and the intermediate bore. The tapering bore of the restriction segment may connect respective ends of the first outer bore and the intermediate bore to each other. The tapering bore of the restriction segment may conically taper downwardly from a connection location with the first outer bore to a connection location with the intermediate bore. The expansion segment may include a tapering bore that extends between the second outer bore and the intermediate bore. The tapering bore of the expansion segment may connect respective ends of the second outer bore and the intermediate bore to each other. The tapering bore of the expansion segment may conically taper downwardly from a connection location with the second outer bore to a connection location with the intermediate bore. In this way, (i) the first opening and restriction segment, and (ii) the second opening and the expansion segment may be mirror images of each other about a cross-sectional plane that extends transversely through a center of the orifice plate. This may allow the orifice plate to be flipped over so that at each orifice, what was initially an expansion segment can serve as a subsequent restriction segment and what was initially a restriction segment can serve as a subsequent expansion segment so as to provide improved textural characteristics of a food product that may result from radial compression followed by controlled and restricted radial expansion of the food product while traveling through the orifice plate, regardless of which end surface of the orifice plate faces upstream versus downstream.

In another aspect, a grinding machine for processing material is provided. The grinding machine includes a grinder assembly adapted to receive a material to be processed and convey the material along a travel path extending generally longitudinally with respect to the grinder assembly, and an orifice plate arranged with respect to the grinder assembly to have the material forced through the orifice plate while the material is conveyed through the grinder assembly. The orifice plate includes a first end surface facing upstream with respect to the travel path of the material, a second end surface facing downstream with respect to the travel path of the material, and a plurality of orifices defined through the orifice plate from the first end surface to the second end surface. At least one of the plurality of orifices includes a first opening defined at the first end surface and having a first width, a second opening defined at the second end surface and having a second width, an intermediate portion between the first and second openings and having a third width that is smaller than the first width and the second width, a restriction segment defined between the first opening and the intermediate portion, and an expansion segment defined between the intermediate portion and the second opening.

In a further aspect, a grinding machine for processing a material is provided and includes a grinder assembly adapted to receive a material to be processed and convey the material along a travel path extending generally longitudinally with respect to the grinder assembly, and an orifice plate arranged with respect to the grinder assembly to have the material forced through the orifice plate while the material is conveyed through the grinder assembly. The orifice plate includes opposing first and second end surfaces and multiple orifices defined through the orifice plate from the first end surface to the second end surface. At least one of the multiple orifices includes a restriction segment including a length and a width with the width of the restriction segment decreasing moving along the length in a first direction from the first end surface toward the second end surface, and an expansion segment operably connected with the restriction segment and including a length and a width with the width of the expansion segment decreasing moving along the length in a second direction from the second end surface toward the first end surface.

In still another aspect, an orifice plate for a grinding machine is provided and includes a first end surface, a second end surface opposite the first end surface, and a plurality of orifices defined in the orifice plate from the first end surface to the second end surface. At least one of the plurality of orifices includes a first tapered section decreasing in width as it extends in a first direction from the first end surface toward the second end surface and a second tapered section decreasing in width as it extends in a second direction from the second end surface toward the first end surface.

A method of using a grinding machine for processing a material is provided. The method includes mounting an orifice plate that has multiple orifices extending there through in a grinder assembly in a first position, in which a first end surface of the orifice plate faces an upstream direction with respect to a travel path along which the material is conveyed through the grinder assembly and a second end surface of the orifice plate faces a downstream direction with respect to the travel path of the material. At least one of the orifices of the orifice plate tapers inwardly from both the first and second end surfaces. The method also includes forcing the material through the multiple orifices of the orifice plate while the orifice plate is in the first position, mounting the orifice plate in the grinder assembly in a second position, in which the second end surface of the orifice plate faces the upstream direction and the first end surface of the orifice plate faces the downstream direction, and forcing the material through the multiple orifices of the orifice plate while the orifice plate is in the second position.

Various other features, objects, and advantages of the invention will be made apparent from the following description taken together with the drawings.

BRIEF DESCRIPTION OF THE DRAWINGS

The accompanying figures, where like reference numerals refer to identical or functionally similar elements throughout the separate views, together with the detailed description below, are incorporated in and form part of the specification, and serve to further illustrate embodiments of concepts that include the claimed invention, and explain various principles and advantages of those embodiments.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present disclosure.

DETAILED DESCRIPTION

Figure 1:
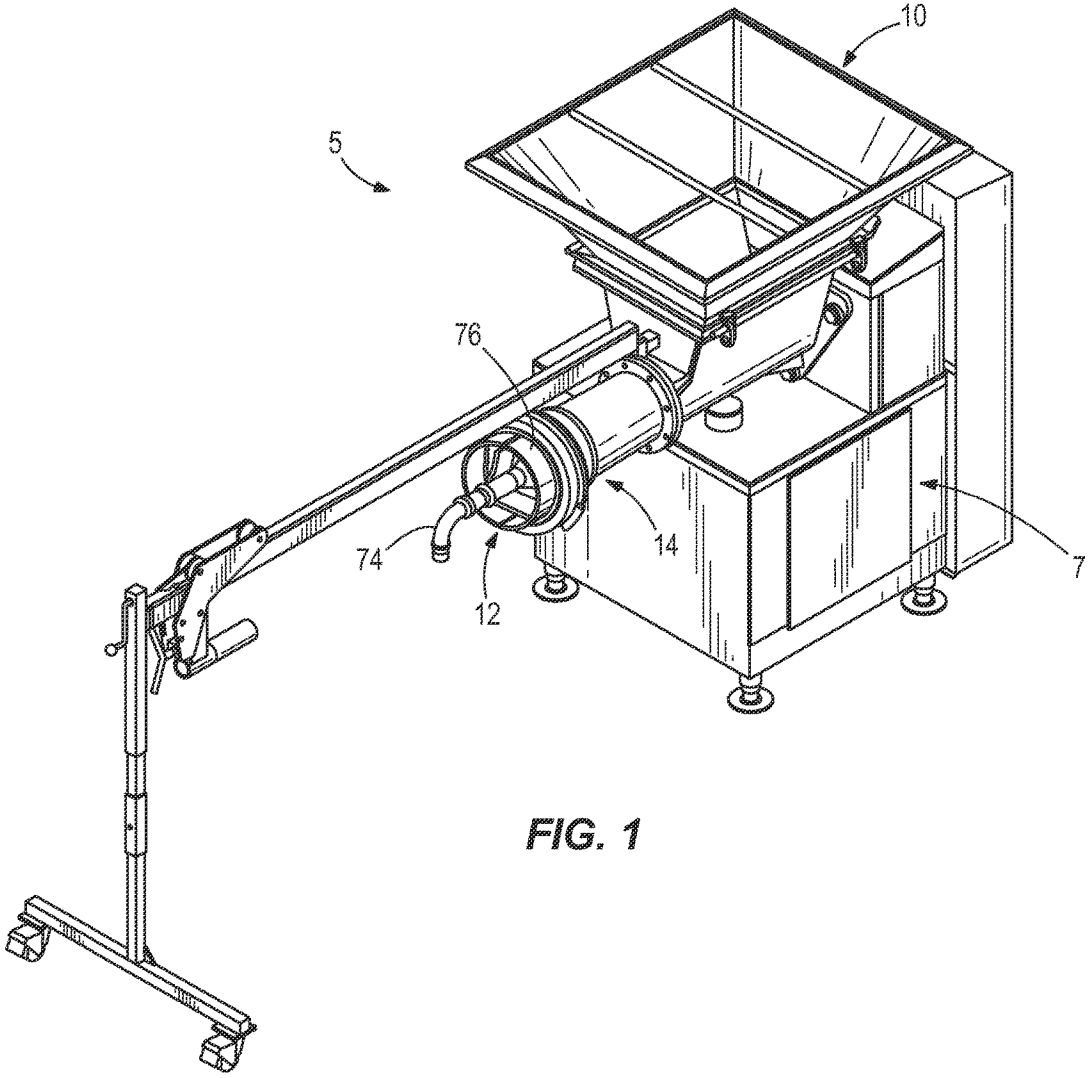
FIG. 1 is a top isometric view of an exemplary grinding machine incorporating various aspects of the present invention.

FIG. 1 illustrates an exemplary grinding machine 5 used for processing materials such as, for example, food and other products. The grinding machine 5 is described as being used for converting meat, trimmings, and/or other meat stock (hereinafter "meat"), by way of grinding, into a ground meat product(s), while noting that grinding machine 5 in other embodiments may be implemented for grinding-type processing of other materials, which may be food materials and other products. A suitable grinding machine 5 and its components are disclosed in the commonly owned U.S. Pat. No. 7,905,436, the entire disclosure of which is incorporated herein by reference. The grinding machine 5 includes a base 7 that houses various mechanical components (including electric motors, drive components, and controls), as is known for suitably operating the grinding machine 5. The grinding machine 5 has a hopper assembly 10 into which the meat is introduced into the grinding machine 5 and a grinder assembly 12 that processes the meat into a ground meat product(s). Grinder assembly 12 includes a grinder head 14 in which an orifice plate 60 is incorporated, as explained in greater detail elsewhere herein.

Figure 2:
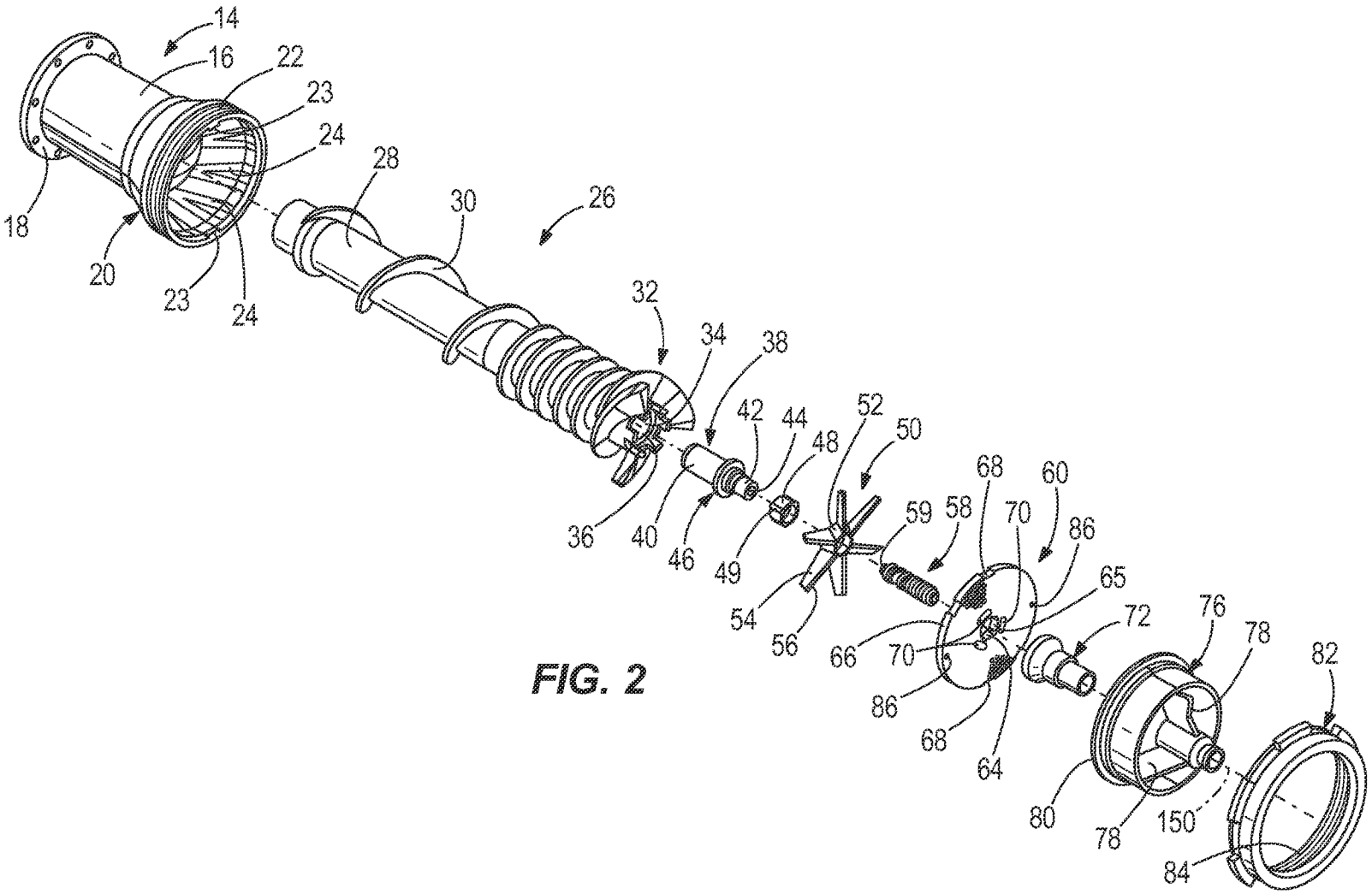
FIG. 2 is an exploded view of a grinder assembly of the grinding machine shown in FIG. 1, the grinding assembly includes an exemplary orifice plate.

Referring now to FIG. 2, the grinder head 14 includes a generally tubular body 16, with a flange 18 at one end of the body 16 that connects to the hopper assembly 10. An opposing end of the tubular body 16 includes an outlet 20 that expands conically from the remainder of the tubular body 16 and has an externally threaded collar 22 and lugs 23 that extend radially inward toward a center of an opening defined at the outlet 20. At least a portion of an inner surface of the grinder head tubular body 16 includes flutes 24 that extend inwardly, radially toward a central longitudinal axis 150 of the grinder head 14 and are aligned angularly with respect to the central longitudinal axis 150 so as to define a spiraling arrangement. The particular dimensions of the flutes 24 may vary along their lengths and are selected to produce desired flow characteristics of meat through the grinder head 14, for example, to control a rate of material backflow between adjacent flutes 24.

With further reference to FIG. 2, feed screw 26 is concentrically and rotationally mounted in the grinder head tubular body 16 and is arranged so that rotation of the feed screw 26 advances the meat from the hopper assembly 10 through the grinder head 14. In this way, a central longitudinal axis 150 of the feed screw 26 corresponds to a travel path that extends generally longitudinally through the grinder head 14 and thus grinder assembly 12, along which the meat is conveyed. When assembled, a single central longitudinal axis 150 extends through a longitudinal center of the components of the grinder assembly 12. Feed screw 26 has a circumferential sidewall 28 and flutes 30 that extend outwardly, radially from the circumferential sidewall 28 and are aligned angularly with respect to a central longitudinal axis 150 of the feed screw 26 so as to define a spiraling arrangement. Like the inwardly extending flutes 24 of the grinder head tubular body 16, the outwardly extending flutes 30 of the feed screw 26 can have dimensions that vary along their lengths and that are selected to produce desired flow characteristics of meat through the grinder head 14. An outlet end 32 of the feed screw 26 that is concentrically housed in the outlet 20 of the grinder head tubular body 16 includes a centrally located bore 34 that extends longitudinally into the feed screw 26. A shoulder 36 is defined at a bottom surface of a counter bore that extends into the outlet end 32 of the feed screw 26.

With continued reference to FIG. 2, a center pin 38 includes a first end 40 that is housed in the bore 34 at the feed screw outlet end 32 and a second end 42 that extends outwardly beyond the feed screw outlet end 32. A bore 44 extends into the second end 42 of the center pin 38. A spacer washer and spring pack assembly 46 is concentrically arranged on the center pin 38, near the second end 42. In the complete assemblage, the second end 42 extends beyond the spacer washer and spring pack assembly 46, a first side of the spacer washer and spring pack assembly 46 abuts the shoulder 36 of the feed screw outlet end 32, and a second side of the spacer washer and spring pack assembly 46 face an opposite direction, away from the shoulder 36. A bushing 48 with longitudinally extending spaced apart lugs 49 at its exterior surface is concentrically arranged upon the second end 42 of the center pin 38. A knife assembly 50 has a central hub 52 and radially extending arms 54 to which blades 56 are mounted. The central hub 52 is arranged concentrically on the second end 42 of the center pin 38 so that the spacer washer and spring pack assembly 46 engages and biases the central hub 52, and thus the entire knife assembly 50, away from the feed screw shoulder 36.

An auger 58 has a post 59 at an inwardly facing end that inserts into the bore 44 of the second end 42 of the center pin 38. The feed screw 26, knife assembly 50, and auger 58 are keyed or otherwise locked in rotational unison with each other. Orifice plate 60, explained in greater detail elsewhere herein, is arranged with respect to the grinder head 14 so that the meat is forced through the orifice plate 60 while being conveyed through the grinder head 14 by operation of feed screw 26. Orifice plate 60 has an inner surface 62 (FIG. 3) including spaced apart depressions 64 that accept the lugs 49 of the bushing 48 and defines an outer periphery of a central opening 65 in which the bushing 48 is arranged. Orifice plate 60 includes an outer surface 66 that has notches 68 that engage the lugs 23 of the grinder head outlet 20. This engagement prevents rotation of the orifice plate 60 relative to the grinder head 14. Thus, the orifice plate 60 is maintained in a fixed position with respect to the grinder head 14 while the blades 56 of the knife assembly 50 are pushed against, as biased by the spacer washer and spring pack assembly 46, and rotationally scrape across, the orifice plate 60. As shown in FIG. 2, orifice plate 60 may include collection passages 70 that allow hard materials such as bone gristle, which are unable to be cut by the blades 56, to pass there through.

Still referring to FIG. 2, collection cone 72 is arranged concentrically outside of the auger 58 and abuts the orifice plate 60 so that hard materials that pass through the collection passages 70 of the orifice plate 60 are directed into the collection cone 72. Rotation of the auger 58 within the collection cone 72 advances the hard materials through the collection cone 72 and a collection discharge tube 74 (FIG. 1) that is operably connected to the collection cone 72. A bridge 76 that has radially extending plate guards 78 which prevent access into the grinder head 14 concentrically supports the collection cone 72. The bridge 76 includes a rim 80 that engages an outer portion of the orifice plate 60. A mounting ring 82 with internal threads 84 holds the bridge 76 against the orifice plate 60 by way of the mounting ring internal threads 84 engaging the threaded collar 22 of the grinder head tubular body 16 so as to secure the mounting ring 82 to the grinder head 14.

Figure 3:
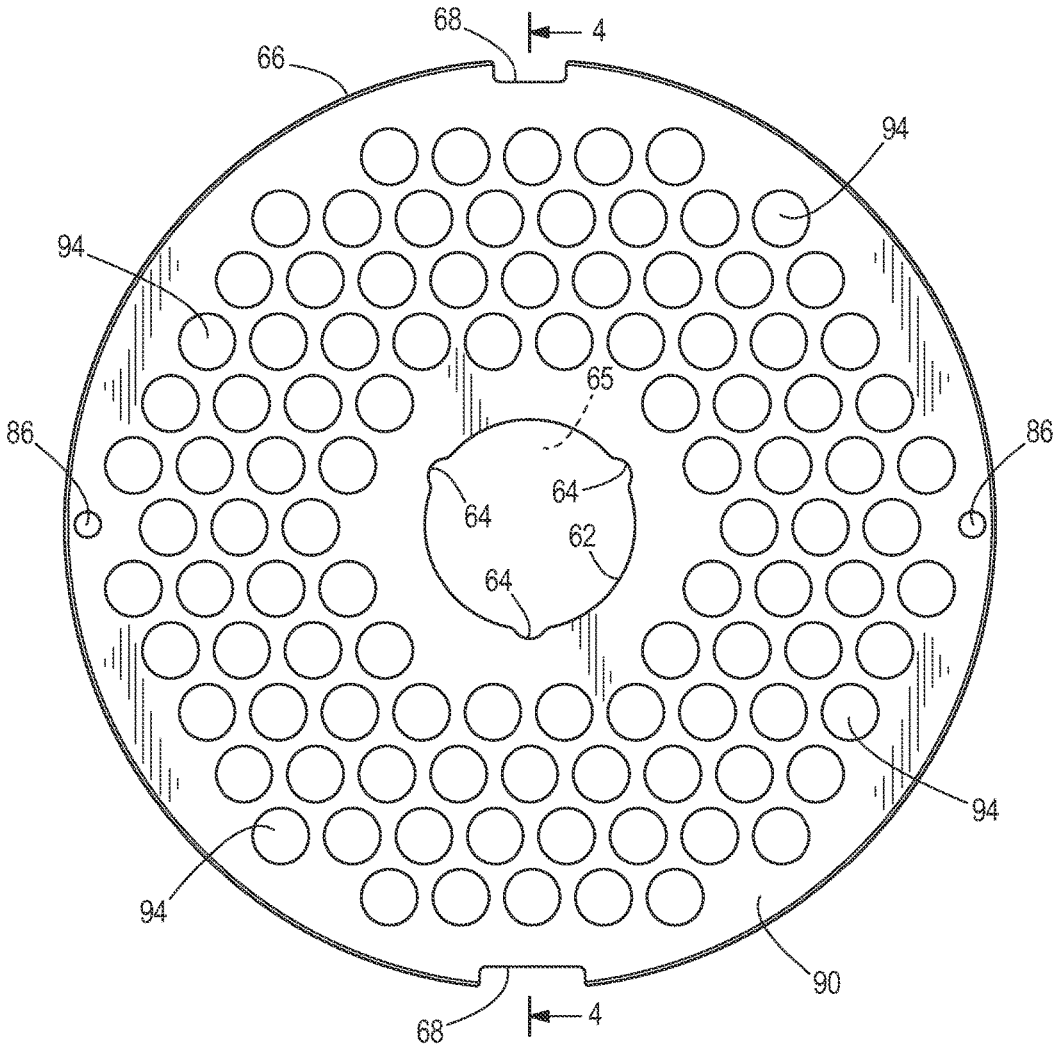
FIG. 3 is a front elevational view of the orifice plate shown in FIG. 2.
Figure 4:
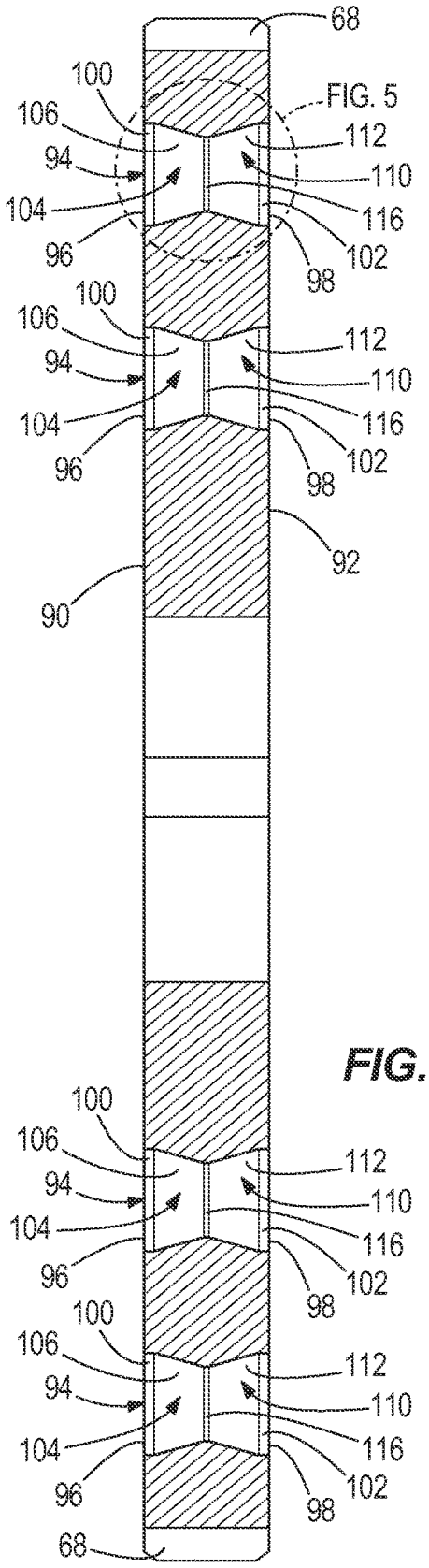
FIG. 4 is a cross-sectional view of the orifice plate taken along line 4-4 in FIG. 3.

Referring now to FIG. 3, the orifice plate 60 has a generally circular outer perimeter shape that is defined by the outer surface 66 with the notches 68 extending inwardly, on opposing sides of the orifice plate 60. The orifice plate 60 has a generally circular inner perimeter shape that is defined by the inner surface 62 from which depressions 64 extend. A pair of mounting apertures 86 extends through outer portions and on opposing sides of the orifice plate 60. The mounting apertures 86 receive pins that extend from the bridge rim 80 to maintain registration of the orifice plate 60 and the bridge 76. As shown in FIG. 4, the orifice plate 60 has a first end surface 90 and an opposing second end surface 92, between which a thickness of the orifice plate 60 is defined.

Referring now to FIGS. 3 and 4, the orifice plate 60 defines multiple orifices 94 there through from the first end surface 90 to the second end surface 92. The orifices 94 are spaced apart from each other extend through the entire orifice plate 60 so as to provide a perforated configuration of the orifice plate 60 through which the meat can be forced during use of the grinding machine 5 (FIG. 1).

Figure 5:
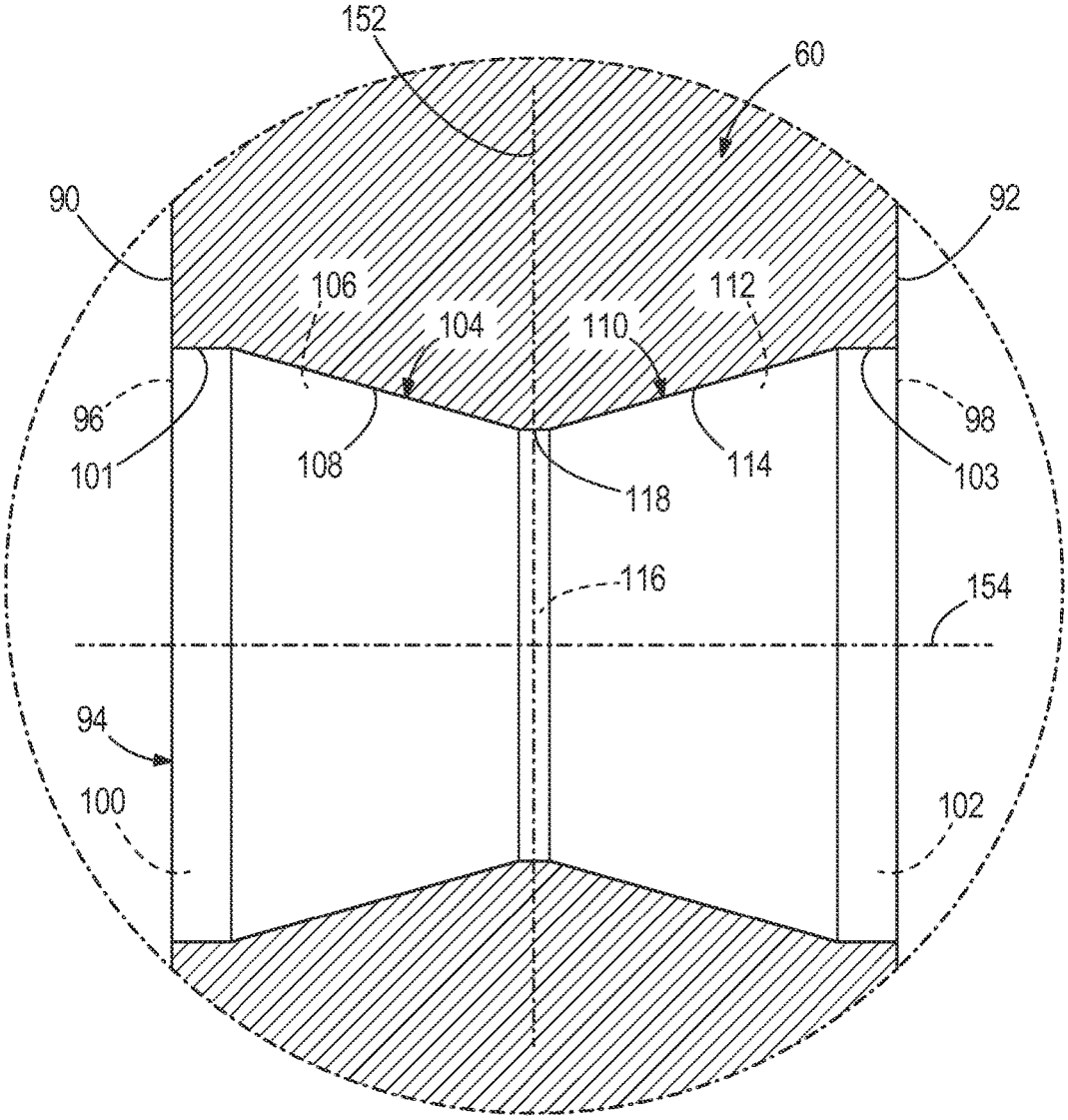
FIG. 5 is an enlarged detail of a portion of FIG. 4 taken at dashed circle 5 in FIG. 4.

Referring now to FIGS. 4 and 5, each orifice 94 of this embodiment is substantially symmetrical about a midpoint 152 along its length when viewed from transverse cross-section such as those of FIGS. 4 and 5. Each orifice 94 includes a first opening 96 at the first end surface 90 and a second opening 98 at the second end surface 92. A first outer bore 100 is arranged radially inward of a first outer bore side wall 101 (FIG. 5) that extends from the first opening 96 into the first end surface 90 toward the second end surface 92. A second outer bore 102 is arranged radially inward of a second outer bore side wall 103 (FIG. 5) that extends from the second opening 98 into the second end surface 92 toward the first end surface 90. The first and second outer bores 100, 102 have the same opening widths as the first and second openings 96, 98, respectively, and define substantially constant opening widths or diameters along their lengths.

With further reference to FIGS. 4 and 5, each orifice 94 defines a restriction segment 104 which is defined by a tapering bore 106 (FIG. 5) that is arranged radially inward of a first tapering side wall 108 that connects to the inward most portion of the first outer bore side wall 101. An expansion segment 110 is defined by a tapering bore 112 that is arranged radially inward of a second tapering side wall 114 (FIG. 5) that connects to the inward most portion of the second outer bore side wall 103. The first and second tapering side walls 108, 114 may extend at a variety of different angels with respect to a central longitudinal axis 154 of the orifice 94 and be within the spirit and scope of the present invention. In some exemplary embodiments, the first and second tapering side walls 108, 114 may extend at angles of between about 10 degrees and about 20 degrees. In other exemplary embodiments, the walls 108, 114 may extend at an angle of about 15 degrees.

With continued reference to FIGS. 4 and 5, an intermediate bore 116 extends between and connects the restriction and expansion segments 104, 110 to each other. The intermediate bore 116 is arranged radially inward of an intermediate side wall 118 that extends between and connects the inward most portions of the first and second tapering side walls 108, 114. Like the first and second outer bores 100, 102, the intermediate bore 116 has a substantially constant opening width diameter along its length. However, the intermediate bore 116 has a smaller diameter than the diameters of the first and second outer bores 100, 102. In some exemplary embodiments, the intermediate bore 116 may have a diameter that is about three-quarters of the diameter of first and second outer bores 100, 102. In one exemplary embodiment, the first and second outer bores 100, 102 may have diameters of about one inch and the intermediate bore 116 may have a diameter of about three-quarters of an inch.

In light of the above, the orifice plate 60 is directionally indifferent, whereby the orifice plate 60 can be mounted in the grinder assembly with either the first or second end surface 90, 92 facing toward the knife assembly (FIG. 2). That is because the orifice plate 60 is symmetrical about a cross-sectional plane that extends transversely through a midpoint of the intermediate bore 116, so that (i) the first opening 96, first outer bore 100, and restriction segment 104 and (ii) the second opening 98, second outer bore 102, and expansion segment 110, respectively, are mirror images of each other.

Accordingly, the orifice plate 60 can be mounted in the grinder assembly 12 in a first position in which the first end surface 90 faces an upstream direction so that the first end surface 90 is engaged by the knife assembly 50 (FIG. 2) and the second end surface 92 faces a downstream direction. The grinding machine 5 (FIG. 1) can be operated with the orifice plate 60 in the first position until the first end surface 90 endures sufficient wear to justify changing. This may occur when, for example, the sharp corner edges defined at the first openings 96 of the orifices 94 dull due to the engagements with the knife assembly 50 and/or the meat being forced through the orifice plate 60, or when the first end surface 90 wears sufficiently so that it is no longer flat enough to provide a shearing interface against which the knife assembly 50 can scrape. At this point, instead of replacing the orifice plate 60 with a new orifice plate 60, the orifice plate 60 is flipped over. Referring to FIG. 2, this is done by partially disassembling the grinder assembly 12 by removing the mounting ring 82, bridge 76, and collection cone 72. The orifice plate 60 is axially withdrawn from the grinder assembly 12 so that the notches 68 are free of their engagement with the posts 23 of the grinder head 14. The orifice plate 60 is then flipped over so that the second end surface 92 faces toward the knife assembly 50. The notches 68 of the orifice plate 60 are aligned with and slid into engagement upon the lugs 23 of the grinder head 14. The collection cone 72, bridge 76, and mounting ring 82 are reinstalled into the grinder assembly 12. Upon reassembly of these components, the orifice plate 60 is in a second position. The grinding machine 5 (FIG. 1) is operated again with the orifice plate 60 in the second position. While in the second position of the orifice plate 60, the orifices 94 impart the same compression and restriction along with allowing for the same post-compression expansion as they did when the orifice plate 60 was in the first position.

It is understood that the drawings and the above relate to a certain embodiment of the present invention, but that the invention is not limited to the specific configuration shown and described. For example, while the orifices are shown as having outer bores and then tapered sections that lead to intermediate bore, it is contemplated that the tapered sections of the bores may be formed to extend all the way to the outer surfaces of the orifice plate. It is also contemplated that the intermediate bore may be eliminated and that the tapered sections of the bore may directly intersect each other at or near the center of the orifice plate. It is further contemplated that the intermediate bore may have a longer length than that shown and described. In addition, it is contemplated that the bores need not necessarily be symmetrical about a central plane of the orifice plate. For example, the orifices on one side of the orifice plate may have a greater or lesser angle of taper then on the other, so that a selected side of the orifice plate can be used, for example, according to certain characteristics of the material being ground. It is also understood that, while the drawings and description relate to all orifices having a tapered configuration, only certain of the orifices may be tapered and others may be straight-sided.

The Abstract is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various embodiments for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus, the following claims are hereby incorporated into the Detailed Description, with each claim standing on its own as a separately claimed subject matter.

While various embodiments of the invention have been described, it will be apparent to those of ordinary skill in the art that other embodiments and implementations are possible within the scope of the invention. Accordingly, the invention is not to be restricted except in light of the attached claims and their equivalents.

What is claimed is:

1. An orifice plate for a grinding machine, the orifice plate comprising:

a first end surface;

a second end surface opposite the first end surface; and a plurality of orifices defined through the orifice plate from the first end surface to the second end surface, wherein at least one of the plurality of orifices includes a first opening defined at the first end surface and having a first width, a second opening defined at the second end surface and having a second width, an intermediate portion between the first and second openings and having a third width that is smaller than the first width and the second width, a first outer bore that extends from the first opening into the first end surface toward the intermediate portion, wherein the first outer bore includes a length and a width, a second outer bore that extends from the second opening into the second end surface toward the intermediate portion, wherein the second outer bore includes a length and a width, wherein the widths of the first and second outer bores are constant along the respective lengths, a restriction segment defined between the first outer bore and the intermediate portion, wherein the restriction segment tapers between the first outer bore and the intermediate portion, and an expansion segment defined between the intermediate portion and the second outer bore, wherein the expansion segment expands between the intermediate portion and the second outer bore.

2. The orifice plate of claim 1, wherein the orifice plate is symmetrical about a plane that extends transversely through a center of the orifice plate such that (i) the first opening and the restriction segment, and (ii) the second opening and the expansion segment are mirror images of each other about the plane.

3. The orifice plate of claim 1, wherein the first and second openings have circular perimeters and the first and second widths are a same size.

4. The orifice plate of claim 3, wherein the intermediate portion comprises an intermediate bore having a circular perimeter that is aligned coaxially with the first and second openings.

5. The orifice plate of claim 1, wherein the first outer bore has a same diameter as the first opening and the second outer bore has a same diameter as the second opening.

6. The orifice plate of claim 1, wherein the first and second outer bores have a same diameter as the first and second openings.

7. The orifice plate of claim 1, wherein the restriction segment connects the first outer bore and the intermediate portion to each other.

8. The orifice plate of claim 1, wherein the restriction segment conically tapers downwardly from a connection location with the first outer bore to a connection location with the intermediate portion.

9. The orifice plate of claim 1, wherein the expansion segment connects the second outer bore and the intermediate portion to each other.

10. The orifice plate of claim 9, wherein the expansion segment conically expands outward from a connection location with the intermediate portion to a connection location with the second outer bore.

11. The orifice plate of claim 1, wherein all of the plurality of orifices include a first opening defined at the first end surface and having a first width, a second opening defined at the second end surface and having a second width, an intermediate portion between the first and second openings and having a third width that is smaller than the first width and the second width, a first outer bore that extends from the first opening into the first end surface toward the intermediate portion, wherein the first outer bore includes a length and a width, a second outer bore that extends from the second opening into the second end surface toward the intermediate portion, wherein the second outer bore includes a length and a width, wherein the widths of the first and second outer bores are constant along the respective lengths, a restriction segment defined between the first outer bore and the intermediate portion, wherein the restriction segment tapers between the first outer bore and the intermediate portion, and an expansion segment defined between the intermediate portion and the second outer bore, wherein the expansion segment expands between the intermediate portion and the second outer bore.

12. An orifice plate for a grinding machine, the orifice plate comprising:

a first end surface;

a second end surface opposite the first end surface; and a plurality of orifices defined through the orifice plate from the first end surface to the second end surface, wherein at least one of the plurality of orifices includes a first opening defined at the first end surface and having a first width, a second opening defined at the second end surface and having a second width, a first outer bore that extends from the first opening into the first end surface toward the second end surface, wherein the first outer bore includes a length and a width, a second outer bore that extends from the second opening into the second end surface toward the first end surface, wherein the second outer bore includes a length and a width, wherein the widths of the first and second outer bores are constant along the respective lengths, a restriction segment that tapers from the first outer bore toward the second end surface, and an expansion segment that expands toward the second end surface.

13. The orifice plate of claim 12, wherein the orifice plate is symmetrical about a plane that extends transversely through a center of the orifice plate such that (i) the first opening and the restriction segment, and (ii) the second opening and the expansion segment are mirror images of each other about the plane.

14. The orifice plate of claim 12, wherein the first and second openings have circular perimeters and the first and second widths are a same size.

15. The orifice plate of claim 12, wherein the first outer bore has a same diameter as the first opening and the second outer bore has a same diameter as the second opening.

16. The orifice plate of claim 12, wherein the first and second outer bores have a same diameter as the first and second openings.

17. The orifice plate of claim 12, wherein the restriction segment conically tapers downward from a connection location with the first outer bore toward the second surface.

18. The orifice plate of claim 12, wherein the expansion segment conically expands outward to a connection location with the second outer bore.

19. The orifice plate of claim 12, wherein all of the plurality of orifices include a first opening defined at the first end surface and having a first width, a second opening defined at the second end surface and having a second width, a first outer bore that extends from the first opening into the first end surface toward the second end surface, wherein the first outer bore includes a length and a width, a second outer bore that extends from the second opening into the second end surface toward the first end surface, wherein the second outer bore includes a length and a width, wherein the widths of the first and second outer bores are constant along the respective lengths, a restriction segment that tapers from the first outer bore toward the second end surface, and an expansion segment that expands toward the second surface.

20. An orifice plate for a grinding machine, the orifice plate comprising:

a first end surface;

a second end surface opposite the first end surface; and a plurality of orifices defined through the orifice plate from the first end surface to the second end surface, wherein at least one of the plurality of orifices includes a first opening defined at the first end surface and having a first width, a second opening defined at the second end surface and having a second width, an intermediate portion between the first and second openings and having a third width that is smaller than the first width and the second width, a restriction segment defined between the first opening and the intermediate portion, wherein the restriction segment tapers between the first opening and the intermediate portion, and an expansion segment defined between the intermediate portion and the second opening, wherein the expansion segment expands between the intermediate portion and the second opening.

21. The orifice plate of claim 20, wherein the orifice plate is symmetrical about a plane that extends transversely through a center of the orifice plate such that (i) the first opening and the restriction segment, and (ii) the second opening and the expansion segment are mirror images of each other about the plane.

22. The orifice plate of claim 20, wherein the first and second openings have circular perimeters and the first and second widths are a same size.

23. The orifice plate of claim 20, wherein the restriction segment couples the first opening and the intermediate portion to each other.

24. The orifice plate of claim 20, wherein the restriction segment conically tapers downward in a direction from the first opening toward the intermediate portion.

25. The orifice plate of claim 20, wherein the expansion segment couples the second opening and the intermediate portion to each other.

26. The orifice plate of claim 20, wherein the expansion segment conically expands outward in a direction from the intermediate portion toward the second opening.

27. The orifice plate of claim 20, wherein all of the plurality of orifices include a first opening defined at the first end surface and having a first width, a second opening defined at the second end surface and having a second width, an intermediate portion between the first and second openings and having a third width that is smaller than the first width and the second width, a restriction segment defined between the first opening and the intermediate portion, wherein the restriction segment tapers between the first opening and the intermediate portion, and an expansion segment defined between the intermediate portion and the second opening, wherein the expansion segment expands between the intermediate portion and the second opening.

* * * * *